United States Patent [19]

Delprato et al.

[11] Patent Number: 4,873,182

[45] Date of Patent: Oct. 10, 1989

[54] LIGHT-SENSITIVE SILVER HALIDE PHOTOGRAPHIC MATERIALS AND PROCESS FOR INCORPORATING HYDROPHOBIC PHOTOGRAPHIC ADDITIVES INTO HYDROPHILIC COLLOID COMPOSITIONS

[75] Inventors: Ivano Delprato; Agostino Baldassarri, both of Savona, Italy

[73] Assignee: Minnesota Mining and Manufacturing Company, St. Paul, Minn.

[21] Appl. No.: 187,271

[22] Filed: Apr. 28, 1988

[30] Foreign Application Priority Data

May 8, 1987 [IT] Italy ..... 20435 A/87

[51] Int. Cl.[4] ..... G03C 1/38; G03C 7/32

[52] U.S. Cl. ..... 430/546; 430/222; 430/449; 430/495; 430/638; 430/935; 252/340; 252/364

[58] Field of Search ..... 430/546, 377, 638, 222, 430/449, 495, 935; 252/364, 340

[56] References Cited

U.S. PATENT DOCUMENTS

| | | | |
|---|---|---|---|
| 2,742,371 | 4/1956 | Albus et al. | 106/180 |
| 3,748,141 | 7/1973 | Smith | 430/546 |
| 3,779,765 | 12/1973 | McCrossen et al. | 430/546 |
| 4,430,421 | 2/1984 | Van de Sande et al. | 430/377 |
| 4,430,422 | 2/1984 | Van de Sande et al. | 430/377 |
| 4,540,657 | 9/1985 | Krishamurthy | 430/546 |

*Primary Examiner*—Richard L. Schilling

*Attorney, Agent, or Firm*—Donald M. Sell; Walter N. Kirn; Mark A. Litman

[57] ABSTRACT

Alkylenglycol aliphatic diesters are water-immiscible high-boiling organic solvents useful for dispersing hydrophobic photographic additives in hydrophilic colloid compositions which are incorporated into the composing layers of light-sensitive silver halide photographic materials.

In particular, said alkylenglycol aliphatic diesters correspond to general formula

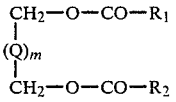

wherein $R_1$ and $R_2$, the same or different, each represents an alkyl group having 1 to 15 carbon atoms, Q represents an acylic hydrocarbon divalent group having 1 to 10 carbon atoms, m represents 0 or 1 and the total number of carbon atoms represented in $R_1+R_2$ is at least 6.

12 Claims, No Drawings

LIGHT-SENSITIVE SILVER HALIDE PHOTOGRAPHIC MATERIALS AND PROCESS FOR INCORPORATING HYDROPHOBIC PHOTOGRAPHIC ADDITIVES INTO HYDROPHILIC COLLOID COMPOSITIONS

FIELD OF THE INVENTION

The present invention relates to light-sensitive silver halide photographic materials comprising, incorporated in hydrophilic colloid component layers, hydrophobic photographic additives dispersed with the aid of water-immiscible high boiling organic solvents.

BACKGROUND OF THE ART

Light-sensitive silver halide photographic materials are comprised of hydrophilic colloid component layers containing various photographic additives. These photographic additives are generally incorporated in the hydrophilic colloid compositions for forming component layers by dissolving them in water or in watermiscible organic solvents and adding the resulting solution to the colloid compositions.

Generally, however, many photographic additives are difficult to dissolve in water and, even when soluble in water-miscible organic solvents, they can be incompatible with hydrophilic colloid compositions when incorporated therein with said organic solutions. This is the case of many photographic additives which are rendered non diffusible within the photographic layers by including a long hydrophobic carbon atom chain (a so called hydrophobic (ballasted) photographic additives are, for example, dye-forming couplers, DIR compounds, UV absorbers, antioxidants, image stabilizers, etc.

Typically, the process of incorporating such hydrophobic photographic additives into hydrophobic colloid components layers of photographic materials, such as silver halide emulsion layers, protective layers, intermediate layers and the like, consists in incorporating into hydrophilic colloid coating compositions of said layers the photographic additives in the form of a dispersion of fine droplets consisting of a water-immiscible high boiling organic solvent in which hydrophobic additives have been dissolved.

According to the dispersion technique, the hydrophobic photographic additives generally are dissolved in water-immiscible high boiling organic solvents (also called in the art permanent solvents, crystalloidal solvents, oil-type solvents, oil-formers and the like) and the resulting organic solution is added to an aqueous composition containing a hydrophilic colloid (gelatin) and a dispersing agent (surfactant). The mixture is then passed through a homogeneizing apparatus (colloidal mill) to form a dispersion of fine droplets of said organic solvent comprising the hydrophobic photographic additives. In some cases it may be advantageous to facilitate the dissolution of the additives by use of an auxiliary water-immiscible low boiling organic solvent, which is removed afterwards by evaporation, as described e.g. in U.S. Pat. Nos. 2,801,170; 2,801,171; 2,949,360 and 2,835,579. The obtained dispersion is then mixed with the hydrophilic colloid composition (gelatin silver halide emulsion or other gelatin-containing composition) which is used to form (by coating) the photographic layer.

Processes and organic solvents for dispersing photographic additives are well known in the art, as disclosed for example in U.S. Pat. Nos. 2,322,027, 2,801,171, 2,949,360, 3,554,755, 3,748,141, 3,779,765, 4,353,979, 4,430,421 and 4,430,422.

Organic solvents for dispersing hydrophobic photographic additives are required to meet several needs. They have to possess an excellent dissolving power towards said additives, are not to cause crystallization of additives, must keep the fine droplets stably dispersed, have a refractive index which is as close as possible to that of the hydrophilic colloid werein they are dispersed, and not deteriorate the physical properties of the layers wherein they are incorporated. Moreover, said organic solvents must not negatively affect the photographic properties of the photographic materials wherein they are used to disperse photographic additives. For example, they must not give rise to fogging of the light-sensitive silver halide emulsions, not negatively affect the stability during storage of dye-forming couplers (dispersed with said organic solvents) and of the dyes formed from said couplers during processing (stability to heat, humidity and light).

Accordingly, there is a continous need for providing improved water-immiscible high boiling organic solvents for use in photography to disperse hydrophobic additives and for providing improved techniques for incorporating said additives into photographic layers.

SUMMARY OF THE INVENTION

The present invention refers to the use of alkyleneglycol aliphatic diester compounds as water-immiscible high boiling organic solvents for dispersing hydrophobic photographic additives into hydrophilic colloid compositions which are incorporated in the component layers of light-sensitive silver halide photographic materials.

In particular, said alkyleneglycol aliphatic diester compounds correspond to the general formula

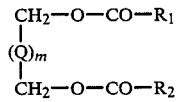

wherein $R_1$ and $R_2$, the same or different, each represents an alkyl group having 1 to 15 carbon atoms, Q represents an acyclic hydrocarbon divalent group having 1 to 10 carbon atoms, m represents 0 or 1 and the total number of carbon atoms represented in $R_1+R_2$ is at least 6.

DETAILED DESCRIPTION OF THE INVENTION

The present invention relates to a light-sensitive silver halide photographic material comprising a support and at least one hydrophilic colloid layer coated thereon, said hydrophilic colloid layer containing hydrophobic photographic additives dispersed in fine droplets of one or more water-immiscible high boiling organic solvents, wherein at least one of said solvents is an alkyleneglycol aliphatic diester compound. This means that said solvent is an aliphatic monocarboxylic acid diester of $\alpha,\Omega$-alkyleneglycol compounds, $\alpha,\Omega$-alkyleneglycol compounds suitable for the preparation of said solvents have alkylene groups having from 2 to 12 carbon atoms, e.g. 1,2-dimethyleneglycol, 1,4-tetramethyleneglycol, 1,6-hexamethylene glycol and 1,8-octamethyleneglycol. Monocarboxylic acid componds suitable for the preparation of said solvents are the saturated acid compounds having the general formula $C_mH_{2m+1}$-COOH and from 2 to 16 carbon atoms. Illustrative examples of saturated monocarboxylic acid compounds are the following acid compounds: acetic, propionic, butyric, valeric, caproic, heptylic, caprylic, pelargonic, capric, lauric, palmitic and stearic. Unsaturated aliphatic monocarboxylic acids, such as oleic and ricinoleic acid, may also be used.

Particularly, the present invention relates to a light-sensitive silver halide photographic material as described above, wherein said alkyleneglycol aliphatic diester compounds are represented by the general structural formula

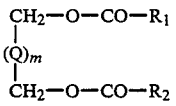

wherein $R_1$ and $R_2$, equal or different, each represents an alkyl group having 1 to 15 carbon atoms, including straight or branched chain alkyl groups, and preferably having 3 to 8 carbon atoms, the total number of carbon atoms in $R_1+R_2$ is at least 6 and preferably at least 10, Q is an acyclic hydrocarbon divalent group having 1 to 10 carbon atoms and preferably 2 to 6 carbon atoms and m is 0 or 1.

In the above general formula, the divalent group represented by Q represents an acyclic hydrocarbon group such as an alkylene group having 1 to 10 carbon atoms, preferably a $-(CH_2)_n-$ group wherein n is a positive integer from 0 to 10 and preferably 2 to 6, e.g., a methylene group, an ethylene group, a trimethylene group, a tetramethylene group, etc. One to three of non adjacent carbon atoms in Q can be replaced by a hetero atom such as a nitrogen atom, a sulfur atom, an oxygen atom, etc. Suitable examples of hetero atom(s) containing groups include a $0-CH_2OCH_2-$group, a $-(CH_2CH_2O)_2-CH_2-CH_2-$group, a $-CH_2CH_2OCH_2CH_2-$group, etc. Also the acyclic hydrocarbon group can be substituted, for example, with one or more of an alkoxy group having 1 to 4 carbon atoms, such as a methoxy group, an ethoxy group, etc., a halogen atom, such as a chlorine atom, a bromine atom, etc., and the like.

The organic solvents for dispersing hydrophobic photographic additives of the present invention are liquid or pasty solid compounds at room temperature, usually have a solubility in water of at most 1% by weight at 20° C. and a boiling point higher than 170° C.

Representative examples of water-immiscible high boiling organic solvents according to the present invention are exemplified below.

| Compound | n | $R_1$ | $R_2$ |
|---|---|---|---|
| (1) | 4 | $-CH(C_2H_5)-(CH_2)_3-CH_3$ | $-CH(C_2H_5)-(CH_2)_3-CH_3$ |
| (2) | 0 | $-CH(C_2H_5)-(CH_2)_3-CH_3$ | $-CH(C_2H_5)-(CH_2)_3-CH_3$ |
| (3) | 6 | $-CH(C_2H_5)-(CH_2)_3-CH_3$ | $-CH(C_2H_5)-(CH_2)_3-CH_3$ |

-continued

| Compound | n | $R_1$ | $R_2$ |
|---|---|---|---|
| (4) | 6 | $-CH(C_2H_5)-(CH_2)_3-CH_3$ | $-CH_3$ |
| (5) | 4 | $-C_4H_9$ | $-C_4H_9$ |
| (6) | 6 | $-(CH_2)_4-CH_3$ | $-(CH_2)_4-CH_3$ |
| (7) | 2 | $-(CH_2)_{10}-CH_3$ | $-(CH_2)_{10}-CH_3$ |
| (8) | 4 | $-(CH_2)_2-CH(CH_3)-CH_3$ | $-(CH_2)_2-CH(CH_3)-CH_3$ |
| (9) | 6 | $-CH(CH_3)-CH_3$ | $-CH(CH_3)-CH_3$ |

The water-immiscible high boiling organic solvents above may be synthetized according to procedures well known in the art of organic chemistry for synthetizing aliphatic esters, such as procedures described in U.S. Pat. No. 2,742,371.

Illustrated below are preparative examples of the above exemplified compounds.

PREPARATIVE EXAMPLE 1: COMPOUND (1)

1565 g (9.62 moles) of a-ethylhexanoyl chloride were added in 3 hours to 516.4 g (4.37 moles) of 1,6hexamethyleneglycol under stirring. The mixture was kept at 90° C. for 8 hours, then poured into 10 1 of water and extracted with ethylether. The organic layer was washed with water, then with a 5% $Na_2CO_3$ water solution and again with water to neutrality. The water solution was dried, concentrated by evaporation and distilled under vacuum. The fraction having a boiling point of 189° C. at 2 mm Hg was collected. The yield was 1328 g (82%).

PREPARATIVE EXAMPLE 2: COMPOUND (2)

The procedure of preparative example 1 was repeated using ethyleneglycol to obtain Compound (2) boiling at 160–162° C. at 2 mm Hg.

PREPARATIVE EXAMPLE 3: COMPOUND (3)

The procedure of preparative example 1 was repeated using 1,8-octamethyleneglycol to obtain Compound (3) boiling at 216°–219° C. at 2.8 mm Hg.

The present invention also relates to a process for incorporating a hydrophobic photographic additive into a hydrophilic colloid composition used to form the colloid layer of a silver halide photographic material, said process comprising the dissolving of a photographic additive in one or more water-immiscible high boiling organic solvents and the dispersion of the resulting solution in said colloid composition, wherein at least one of said organic solvents is an alkyleneglycol aliphatic diester as described above. A photographic additive, in the present invention, is a chemical material which in the presence of photographic silver halide emulsions contribute to the sensitomemtry of the emulsion. Sensitometry relates to activity such as the spectral response, stability, speed, acuity, color formation, fog reduction, ultraviolet radiation absorption, and the like.

In the process of dispersing photographic additives by using organic solvents according to the present invention, different procedures may be satisfactory followed. According to one procedure, the hydrophobic photographic additive to be dispersed is dissolved in the water-immiscible high boiling organic solvent of the present invention. The obtained solution is then added to an aqueous solution of a hydrophilic colloid binder (such as gelatin) and the mixture is emulsified by means of dispersing apparatus (such as a colloidal mill, a homogeneyzer and the like) in the presence of a dispersing agent (generally a surface active agent, such as an anionic surfactant, a nonionic surfactant, a cationic surfactant or a mixture thereof), said dispesing agent being preferably contained in the hydrophilic colloid binder solution. The obtained dispersion is then added to a gelatin silver halide emulsion or an aqueous solution of a hydrophilic colloid which is used for forming light-sensitive image forming layers or light-insensitive auxiliary layers of silver halide photographic materials. Alternatively, it may be advantageous to incorporate the solution of the photographic additive in the organic solvent directly into the coating composition used for forming the component photographic layer and dispersing the mixture. It is also possible to use the organic solvents of the present invention in combination with other known water-immiscible high boiling organic solvents, even if the advantages set forth in the present invention can be attained using the present organic solvents alone. High boiling organic solvents which can be used in combination with the present oganic solvents are, for example, phthalic acid alkyl esters, phosphoric acid esters, citric acid esters, benzoic acid esters, fatty acid esters and the like such as described in US 4,430,421. If necessary, the present high boiling organic solvents and, if present, the known high boiling organic solvents can be used in combination with auxiliary low boiling organic solvents such as those not or almost not soluble in water and having a boiling point of at most 150° C., such as lower alkyl acetates, carbon tetrachloride, methyl ethyl ketone, benzene, ligroine, etc., or water soluble organic solvents such as methanol, ethanol, dimethysulfoxide, tetrahydrofuran, dioxan acetone, etc. Auxiliary low boiling organic solvents are for example described in U.S. Pat. Nos. 2,801,170, 2,801,171, 2,949,360 and 2,835,579.

The amounts of high boiling solvents used according to this invention for dispersing hydrophobic additives can vary according to the used additive. It is, however, undesirable to use large amounts of such solvents, because large excess of solvents may somehow deteriorate the physical properties of the photographic layers. Accordingly, it is normal practice to use the high boiling solvents in a weight ratio to each additive in the range from 0.1 to 8.0, preferably in the range from 0.3 to 3.0.

According to this invention it is possible to improve the stability of hydrophobic photographic additive dispersions. Dye-forming couplers, UV absorbers and other hydrophobic photographic additives can be dispersed into light-sensitive silver halide photographic materials without causing uneveness of the coating or deterioration of image quality. The present invention is particularly advantageous in light-sensitive silver halide color photographic materials wherein excellent stability to light, heat and/or humidity can be imparted to the dye images obtained upon exposure and development of said materials.

Gelatin is the preferred hydrophilic colloid for use in the present invention. However, other water-soluble colloidal substances or mixture thereof can also be used. Exemplary hydrophilic colloidal substances include gelatin derivatives, such as phthalated gelatin and acetylated gelatin, cellulose derivatives, such as carboxymethyl cellulose, starch, casein, zein, synthetic hydrophilic colloids such as polyvinyl alcohol, polyvinyl pyrrolidone, anionic polyurethanes, copolymers of acrylic acid esters, acrylonitrile and acrylamides, etc.

The hydrophobic photographic additives, which are dispersed with the aid of the water-immiscible organic solvents according to the present invention, are those which, when incorporated into the costituent layers of silver halide photographic materials, are required not to substantially diffuse within the layers themselves. A group bearing a ballasting substituent such as a hydrophobic residue with from 8 to 30 carbon atoms is introduced into the photographic additive molecule in order to avoid such diffusing process. Said substituent is called a "ballasting chain" and is linked, directly or through one or more of imino, ether, carbonamido, sulfonamido, ureido, ester, imido, carbamoyl, sulfamoyl, phenylene, etc., groups, to the photographic additive molecule. Suitable examples of ballasting chains are illustrated in U.S. Pat. No. 4,009,083, in EP Nos 73,146, 84,100, 87,930 and 87,931, in DE Nos. 3,300,412 and 3,315,012 and in JP Nos. 58-033248, 58-033250, 58-031334 and 58-106539. Preferably, such ballasting chains comprise alkyl groups, the total carbon atoms of which is no more than 20. Usually, said photographic additives have a solubility in water of at most 3% by weight at 20° C. Specficially preferred hydrophobic photographic additives include dye-forming couplers, development-inhibitor-releasing (DIR) couplers, silver halide developers, oxidized developer scavengers, spectral sensitizers and desensitizers, diffusion transfer dye image-formers, visible and ultraviolet light absorbers, which are conventionally introduced in hydrophilic colloid layers of photographic elements dispersed in water-immiscible high boiling solvents. other hydrophobic photographic additives include those used in silver halide photographic elements such as optical brighteners, antioxidants, silver halide solvents, bleachable dyes and the like. Hydrophobic photographic additives for use in the present invention are described in more details in Research Disclosure No. 15930, July 1977.

The silver halide emulsions used in the present invention can be any of the silver halide emulsions known in the art such as silver chloride, silver bromide, silver bromo-chloride, silver chloro-iodide, silver bromo-iodide, silver chloro-bromo-iodide emulsions and mixtures thereof. The emulsions can be composed of coarse, medium and fine grains and can be monodispersed or polydispersed. The silver halide grains may be those having a regular crystal form, such as a cube or an octahedron, or those having an irregular crystal form, such as spherical or tabular, etc., or may be those having a composite crystal form. They may be composed of a mixture of grains having different crystal forms. Their size can be varied on a wide range, but in general average grain sizes from 0.1 to 4 μm are suitable.

The silver halide emulsions used in the present invention may be obtained according to any of the known acid, neutral and ammoniacal method using conventional precipitation methods such as a single or twin jet method. Further, the silver halide emulsions may be chemically sensitized with a sulfur sensitizer, such as allylthiocarbamide, thiourea, crystine, etc.; an active or insert selenium sensitizer; a reducing sensitizer such as stannous salt, a polyamine, etc.; a noble metal sensitizer, such as gold sensitizer, more specifically potassium aurithiocyanate, potassium chloroaurate, etc.; or a sensitizer of a water soluble salt such as for instance of ruthenium, rhodium, iridium and the like, more specifically, ammonium chloropalladate, potassium chloroplatinate and sodium chloropalladite, etc.; each being employed either alone or in a suitable combination.

Furthermore, the above silver halide emulsions may contain various known additives for photography. For example, there may be employed additives for photography as disclosed in Research Disclosure, Item 17643, December 1978.

Moreover, the silver halides may be optically sensitized to a desired region of the visible spectrum. The method for spectral sensitization of the present invention is notparticularly limited. For example, optical sensitization may be possible by using an optical sensitizer, including a cyanine dye, a merocyanine dye, complex cyanine and merocyanine dyes, oxonol dyes, hemioxonol dyes, styryl dyes and streptocyanine dyes, either alone or in combination. Particularly useful optical sensitizers are the dyes of the benzoxazole-, benzimidazole- and benzothiazole-carbocyanine type.

The above emulsions may also contain various additives conveniently used depending upon their purpose. These additives include, for example, stabilizers or antifoggants such as azaindenes, triazoles, tetrazoles, imidazolium salts, polyhydroxy compounds and others; film hardeners such as of the aldehyde, aziridine, isoxazole, vinylsulfone, acryloyl, triazine type, etc.; developing promoters such as benzyl alcohol, polyoxyethylene type compounds, etc.; image stabilizers such as compounds of the chromane, cumarane, bisphenol type, etc.; and lubricants such as wax, higher fatty acids glycerides, higher alcohol esters of higher fatty acids, etc. Also, coating aids, modifiers of the permeability in the processing liquids, defoaming agents, antistatic agents and matting agents may be used. As hydrophilic colloids to be used in the emulsion according to the present invention, not only gelatin but also gelatin derivatives, polymer grafts for gelatin, synthetic hydrophilic macromolecular substances and natural hydrophilic macromolecular substances other than gelatin may also be available either singly or in a mixture. Also, synthetic latexes may be added to gelatin to improve the film properties such as copolymers of acrylic acid esters, vinyl esters, etc. with other monomers having ethylenic groups.

As the support for the light-sensitive element, there may be used, for example, baryta paper, polyethylene-coated paper, polypropylene synthetic paper, cellulose acetate, polystyrene, a polyester film such as polyethyleneterephthalate, etc. These supports may be chosen depending upon the purpose of use of the light-sensitive silver halide photographic material. The supports may be provided with a subbing layer, if necessary.

The photographic emulsions used in the present invention can be used for black-and-white light-sensitive negative elements, light-sensitive positive elements, X-Ray elements, lithographic elements, black-and-white and color light-sensitive elements for diffusion transfer processes and light-sensitive elements which contain oil-soluble or water-soluble color couplers.

Preferably, the silver halide emulsions according to the present invention are designed for multicolor elements commprising dye image forming units sensitive to each of the three primary regions (blue, green and red) of the visible spectrum. Each unit can be formed by a single emulsion layer or multiple emulsion layers sensitive to the same spectral region.

More preferably, the silver halide emulsions according to the present invention are designed for a multicolor element comprising a support bearing at least one blue-sensitive silver halide emulsion layer and preferably two blue-sensitive silver halide emulsion layers of different sensitivity associated to yellow dye forming couplers, at least one green sensitive silver halide emulsion layer and preferably at least two green-sensitive silver halide emulsion layers of different sensitivity associated to magneta dye forming couplers, at least one red-sensitive silver halide emulsion layer and preferably at least two red-sensitive silver halide emulsion layers of different sensitivity associated to cyan dye forming couplers, and additional non light-sensitive hydrophilic colloid layers (such as protective layers, intermediate layers, filter layers, subbing layers, backing layers and the like), wherein at least one component layer of said material comprises incorporated therein a hydrophilic photographic additive dispersed with the aid of a water-immiscible high boiling organic solvent according to the present invention, said component layers comprising preferably at least one silver halide emulsion layer including a dye forming coupler.

The following examples further illustrate the invention.

EXAMPLE 1

A solution was obtained by dissolving 8 g of a cyan coupler of formula

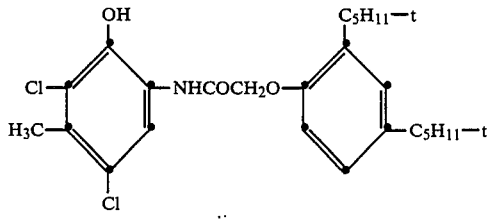

in a mixture of 8 ml of the high boiling solvent (1) and 12 ml of isopropanole is an ausiliary solvent at 60° C. The solution was incorporated in 24 ml of a 10% gelatin solution containing 8 ml of a 5% Nekal TM BX (an alkylnaphthalenesulphonic acid sodium salt of BASF AG) solution and the composition stirred with a rotary mixer at 10,000 r.p.m. and added with 44 ml of water during stirring. The resulting emulsified dispersion was added to a blend of two red sensitized silver halide emulsions. The blend comprised 65% of a low speed AgBrI emulsion (having 2.5% AgI mole and 0.3 μm average grain diameter) and 35% of a medium speed red sensitized AgBrClI emulsion (having 5% AGCl mole, 7% AgI mole and 0.4 μm average grain diameter). Both emulsions were chemically ripened with gold and thiosulphate and added with stabilizers. The emulsion blend including the dispersed coupler was coated, at a silver coverage of 1.3 g/m$^2$ and coupler coverage of 0.73 g/m$^2$, on an antihalation gelatin layer containing gelatin at a coverage of 1.5 g/m$^2$ and black colloidal silver at a coverage of 0.17 g/m$^2$, said antihalation layer being coated on its turn on a cellulose triacetate support base (film 1 of the invention).

Comparison films 2 and 3 were obtained by repeating the same procedure above, except that in place of the present high boiling solvent (1), there were used di-n-buthylphthalate and 1,4-cyclohexyldimethylenebis-(2-ethylhexoate) (high boiling solvent No. 6 of U.S. Pat. No. 3,748,141), respectively.

Samples of each film were exposed to a light source having a color temperature of 5,500° Kelvin through an optical step wedge and developed in a standard type C41 process as described in British Journal of Photography, July 12, 1974, pp. 597–598.

The maximum density of the exposed and processed samples was determined. Next, part of the samples, exposed and processed, were subjected for one week to a heat stability test at 77° C. and a relative humidity of 40% and part to a light stability test for 30 hours to a Xenon lamp. The maximum density was determined again. A comparison between the values of maximum density before and after heat and light treatment gave the loss in maximum density occurred during the heat and light treatment. The following Table 1 reports the percent of loss in maximum density during heat and light treatment.

TABLE 1

| | δ Dmax (in %) | |
|---|---|---|
| Film | Heat treatment | Light treatment |
| 1 (Invention) | −8 | −7 |
| 2-(Comparison) | −32 | −15 |
| 3 (Comparison) | −18 | −16 |

The example shows that heat and light stability of the dye formed in presence of high boiling solvent (1) of the invention are superior to that of the dyes formed in presence of known high boiling solvents.

EXAMPLE 2

Following the dispersion procedure of Example 1, a series of 4 dispersions (D-1 to D-4) was made of the yellow forming coupler having the structural formula:

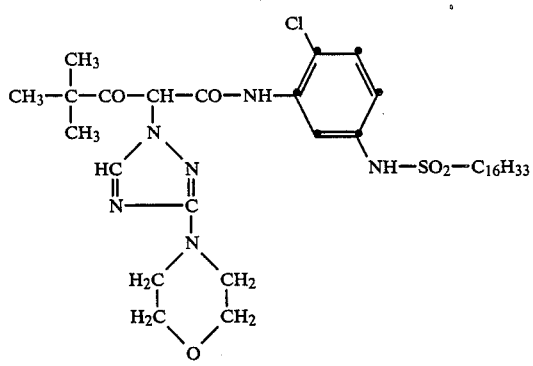

Table 2 reports the composition of each dispersion:

TABLE 2

| | | D-1 | D-2 | D-3 | D-4 |
|---|---|---|---|---|---|
| Coupler | g | 10 | 10 | 10 | 10 |
| Dibuthylphthalate | ml | 2.5 | — | — | — |
| Diethylauramide | ml | 2.5 | — | — | — |
| Compound (1) | ml | — | 3 | 5 | 7 |
| Ethylacetate | ml | 10 | 10 | 10 | 10 |

TABLE 2-continued

| | | D-1 | D-2 | D-3 | D-4 |
|---|---|---|---|---|---|
| 10% Gelatin | ml | 4.8 | 2.4 | 2.4 | 2.4 |
| 5% Nekal TM BX BASF | ml | — | 6 | 6 | 6 |
| 10% Hostapur TM SAS HOECHST | ml | 3.7 | — | — | — |
| Water to make | g | 100 | 100 | 100 | 100 |

A control film (Film 4) was made by coating a subbed cellulose triacetate support with the following layers in the indicated order:

Layer 1:

A less sensitive blue-sensitive silver halide emulsion layer containing a blend of 65% of an AgBrI emulsion (having 3.2% AgI mole and 0.53 μm average grain diameter) and 35% of an AgBrI emulsion (having 3.2% AgI mole and 0.78 μm average grain diameter), both emulsions being chemically ripened with gold and thiosulphate, and dispersion D-1 coated at a total silver coverage of 0.5 g/m$^2$, coupler coverage of 1.15 g/m$^2$ and total gelatin coverage of 1.38 g/m$^2$.

Layer 2:

A more sensitive blue-sensitive silver halide emulsion layer comprising a AgBrI emulsion (having 8% AgI mole and 1.02 μm average grain diameter), chemically ripened with gold and thiosulfate, and dispersion D-1 coated at a silver coverage of 0.65 g/m$^2$, coupler coverage of 0.30 g/m$^2$ and gelatin coverage of 1.05 g/m$^2$.

Other three films (Films 5 to 7) were made according to Film 4 but containing dispersions D-2, D-3 and D-4, respectively, at the same silver, coupler and gelatin coverage of Film 4.

Samples of the films were exposed and processed as described in Example 1. Table 3 reports the values of fog, speed and RMS granularity, wherein fog is Dmin, speed is expressed in logE (wherein E is Exposure in meter-candle-seconds and RMS granularity is a measure of diffuse granularity, as described in H.C. Schmitt and J.H. Altman, Method of Measuring Diffuse RMS Granularity, Applied Optics, Vol. 9, pages 871–874, April 1970, at various optical densities.

TABLE 3

| | | | RMS | | |
|---|---|---|---|---|---|
| Film | Fog | Speed | OD = 0.4 | OD = 1 | OD = 1.4 |
| 4 (Comparison) | 0.20 | 1.76 | 6.5 | 6.0 | 4.4 |
| 5 (Invention) | 0.07 | 1.74 | 4.9 | 4.2 | 3.3 |
| 6 (Invention) | 0.07 | 1.72 | 4.9 | 4.2 | 3.3 |
| 7 (Invention) | 0.07 | 1.75 | 4.9 | 4.2 | 3.3 |

The example shows that Films 5, 6 and 7 comprising the high boiling solvent (1) of this invention are improved in fog and RMS in comparison with Film 4 comprising the comparative high boiling solvent.

EXAMPLE 3

Following the dispersion procedure described in Example 1, a series of 3 dispersions (D-5, D-6 and D-7) were made of the yellow forming coupler having the structural formula:

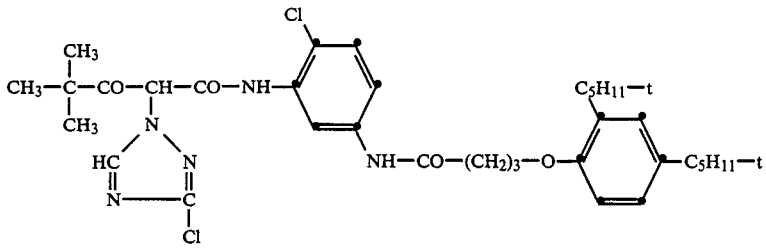

Table 4 reports the composition of each dispersion:

TABLE 4

| | | D-5 | D-6 | D-7 |
|---|---|---|---|---|
| Coupler | g | 10 | 10 | 10 |
| Dibuthylphthalate | ml | 2.5 | 2.5 | 2.5 |
| Diethylauramide | ml | 2.5 | — | — |
| 1,4-Cyclohexyldimethylene-bis-(2-ethylhexoate) | ml | — | 2.5 | — |
| Compound (1) | ml | — | — | 2.5 |
| 10% Gelatin | ml | 4.8 | 4.8 | 4.8 |
| 10% Hostapur TM SAS Hoechst | ml | 3.7 | 3.7 | 3.7 |
| Water to make | g | 100 | 100 | 100 |

A control film (Film 8) was made by coating a subbed cellulose triacetate support with a blue-sensitive silver halide emulsion layer comprising an AgBrI emulsion (having 8% AgI mole and 1,02 μm average grain diameter), chemically ripened with gold and thiosulphate, and dispersion D-5 coated at silver coverage of 1.5 $g/m^2$, coupler coverage of 0.935 $g/m^2$ and gelatin coverage of 1.7 $g/m^2$, wherein coating composition comprising the emulsion and the dispersion was coated just after mixing emulsion and dispersion.

The other two films (Films 9 and 10) were made according to Film 8 but containing dispersions D-6 and D-7, respectively, mixed with the emulsion just before coating, at the same silver, coupler and gelatin coverages of Film 8.

Another control film (Film 11) was made according to Film 8, wherein the coating composition comprising the emulsion and the dispersion D-5 was coated after 12 hours at 38° C.

The other two films (Films 12 and 13) were made according to Film 11 but containing dispersions D-6 and D-7, respectively, wherein each coating composition comprising the emulsion and dispersion was coated after 12 hours at 38° C.

Samples of the films were exposed and processed as described in Example 1. Table 5 reports the values of fog and Dmax of yellow images obtained for each film.

TABLE 5

| Film | Fog | DMax |
|---|---|---|
| 8 (Comparison) | 0.14 | 1.27 |
| 9 (Comparison) | 0.11 | 1.36 |
| 10 (Invention) | 0.09 | 1.28 |
| 11 (Comparison) | 0.15 | 0.94 |
| 12 (Comparison) | 0.15 | 0.73 |
| 13 (Invention) | 0.14 | 1.27 |

The example shows that the resistance to heat treatment of the film containing the high boiling solvent (1) of this invention is superior to that of films containing known high boiling solvents.

We claim:

1. A light-sensitive silver halide photographic material comprising a support and a hydrophilic colloid layer coated thereon, said hydrophilic colloid layer containing hydrophobic photographic additives dispersed in fine droplets of one or more water-immiscible high boiling organic solvents, wherein at least one of said solvents is an alkyleneglycol aliphatic diester compound corresponding to the general structural formula

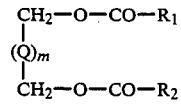

wherein $R_1$ and $R_2$, the same or different, each represents an unsubstituted alkyl group having 1 to 15 carbon atoms, Q represents a linear unsubstituted alkylene group of 1 to 10 carbon atoms or linear halogen substituted alkylene group of 1 to 10 carbon atoms, m represents 0 or 1, and the total number of carbon atoms represented in $R_1 + R_2$ is at least 6.

2. The material of claim 1 wherein Q is $-(CH_2)_n-$ —and n is 1 to 10.

3. The light-sensitive silver halide photographic material of claim 1, wherein said hydrophobic photographic additive is a dye-forming coupler.

4. The light-sensitive silver halide photographic material of claim 1, wherein said hydrophilic colloid layer is a gelatin layer.

5. The light-sensitive silver halide photographic material of claim 1, wherein said hydrophilic colloid layer is a gelatin silver halide emulsion layer.

6. A light-sensitive silver halide photographic material comprising a support and a hydrophilic colloid layer coated thereon, said hydrophilic colloid layer containing hydrophobic photographic additives dispersed in fine droplets of one or more water-immiscible high boiling organic solvents, wherein at least one of said solvents is an alkyleneglycol aliphatic diester compound wherein said silver solvent is selected from the group consisting of 1,6-hexamethyleneglycol di-(2-ethylhexanoate), 1,4-tetramethyleneglycol di-(2-ethylhexanoate) and 1,8-octamethyleneglycol di-(2-ethylhexanoate).

7. A process for incorporating a hydrophobic photographic additive into a hydrophilic colloid composition for forming a photographic layer which comprises dissolving said hydrophobic additive in one or more water-immiscible high boiling organic solvents and dispersing the resulting solution in said hydrophilic colloid composition, wherein at least one of said organic solvents is an alkyleneglycol aliphatic diester compound corresponding to the general structural formula

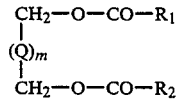

wherein $R_1$ and $R_2$, the same or different, each represents an unsubstituted alkyl group having 1 to 15 carbon atoms, Q represents a linear unsubstituted alkylene group of 1 to 10 carbon atoms or linear halogen substituted alkylene group of 1 to 10 carbon atoms, m represents 0 or 1, and the total number of carbon atoms represented in $R_1 + R_2$ is at least 6.

8. The process of claim 7 wherein Q is $-(CH_2)_n-$ —and n is 1 to 10.

9. The process of claim 7 wherein said hydrophilic colloid composition is a gelatin aqueous composition.

10. The process of claim 7 wherin said hydrophobic additive is a dye-forming coupler.

11. The process of claim 7 wherein said hydrophobic additive is dissolved in said water-immiscible high boiling organic solvents in the presence of a low boiling auxiliary organic solvent.

12. A light-sensitive silver halide photographic material comprising a support and a hydrophilic colloid layer coated thereon, said hydrophilic colloid layer containing hydrophobic photographic additives dispersed in fine droplets of a water-immiscible high boiling organic solvents, wherein said solvent consists essentially of an alkyleneglycol aliphatic diester compound corresponding to the general structural formula

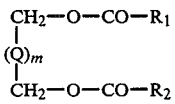

wherein $R_1$ and $R_2$, the same or different, each represents an unsubstituted alkyl group having 1 to 15 carbon atoms, Q represents a linear unsubstituted alkylene group of 1 to 10 carbon atoms or linear halogen substituted alkylene group of 1 to 10 carbon atoms, m represents 0 or 1, and the total number of carbon atoms represented in $R_1 + R_2$ is at least 6.

* * * * *

UNITED STATES PATENT AND TRADEMARK OFFICE

CERTIFICATE OF CORRECTION

PATENT NO. : 4,873,182

DATED : October 10, 1989

INVENTOR(S) : Delprato and Baldassarri

It is certified that error appears in the above-identified patent and that said Letters Patent is hereby corrected as shown below:

Column 1, lines 31 and 32, "(a so called hydrophobic" should be -- (a so called "ballasting chain") in their structural formula. Said hydrophobic --.

Column 2, line 68, "componds" should be --compounds--.

Column 3, line 40, "O-$CH_2OCH_2$-" should be -- -$CH_2OCH_2$- --.

Column 4, line 28, "1,6hexame-" should be -- 1,6-hexame- --.

Column 4, line 60, "sensitomemtry" should be --sensitometry--.

Column 5, line 10, "dispesing" should be --dispersing--.

Column 5, line 27, "oganic" should be --organic--.

Column 6, line 66, "insert" should be --insert--.

Signed and Sealed this

Twenty-sixth Day of November, 1991

*Attest:*

HARRY F. MANBECK, JR.

*Attesting Officer*

*Commissioner of Patents and Trademarks*